United States Patent [19]

Torrini

[11] Patent Number: 4,539,731

[45] Date of Patent: Sep. 10, 1985

[54] BUTTON-COVER

[75] Inventor: Franco Torrini, Florence, Italy

[73] Assignee: Torrini G. S.p.A., Florence, Italy

[21] Appl. No.: 489,521

[22] Filed: Apr. 28, 1983

[30] Foreign Application Priority Data

May 12, 1982 [IT] Italy ..... 11653/82[U]
Nov. 19, 1982 [IT] Italy ..... 11872/82[U]

[51] Int. Cl.[3] ..... A44B 1/16

[52] U.S. Cl. ..... 24/92; 24/104; 24/113 MP

[58] Field of Search ..... 24/92, 90 A, 94, 95, 24/97, 98, 104, 106, 113 MP

[56] References Cited

U.S. PATENT DOCUMENTS

| | | | |
|---|---|---|---|
| 108,520 | 10/1870 | Sackermann | 24/104 |
| 138,745 | 5/1873 | Freeman | 24/104 |
| 581,111 | 4/1897 | Goodwin | 24/113 MP |
| 2,883,725 | 4/1959 | McDonough, Jr. | 24/113 MP |
| 3,439,439 | 4/1969 | Stimson | 24/90 A |
| 3,757,388 | 9/1973 | Wolny | 24/113 MP |

FOREIGN PATENT DOCUMENTS

| | | | |
|---|---|---|---|
| 190710 | 8/1956 | Austria | 24/104 |
| 657867 | 2/1963 | Canada | 24/113 MP |
| 332900 | 6/1903 | France | 24/113 MP |

*Primary Examiner*—Victor N. Sakran
*Attorney, Agent, or Firm*—Browdy and Neimark

[57] ABSTRACT

A button cover for use in particular with shirt cuff button and generally to cover buttons on any article of clothing, formed by a button covering member and a button engaging member pivotally connected one to another. A perimeter spacing edge is provided therebetween, divided in two portions respectively integral with the covering member and the engaging member, an opening being formed in it. By rotating the covering member with respect to the engaging member, a passage is provided for the button thread when accomodating the button therebetween. Fastening means are provided for securing said covering member and said engaging member one to another after the button is interposed therebetween.

5 Claims, 3 Drawing Figures

BUTTON-COVER

The present invention refers to a button-cover, particularly for shirt cuffs. More precisely, the invention refers to a decorative accessory for male shirts that, when applied over the cuff buttons, simulates the presence of cuff-links. The advantage of the button-cover according to the present invention, with respect to a traditional cuff-link, consists in that it can be used in conjunction with any kind of shirt, without requiring the characteristic pair of buttonholes that is, on the contrary, necessary when using cuff-links. More in general, the button-cover according to the invention may be used in combination with any other article of clothing, if that is considered to produce an aesthetically attractive effect.

The button-cover according to the invention comprises a first member having an opening for engaging the button in a substantially coaxial relation, adapted to be interposed between the button and the cuff to which it is sewn, said opening having a smaller diameter than that of the button itself. The first member is articulated with respect to a second member designed to cover the button and to be placed in a parallel, spaced relationship with respect to said first member. A perimeter spacing edge is provided between said first and second members formed by two complementary portions respectively integral with said first and second members. An articulated connection is provided between said first and second members for discontinuing said perimetrical spacing edge, thus providing a passage for the button thread when accomodating the button therebetween, means being finally provided for securing said first and second members in a closed superimposed position.

As a particular case, said members of the invention button cover can be pivotally connected along corresponding ends of their respective edges: in this case a pivot axis is perpendicular to them and the passage for the button thread, when the button cover has been installed on the button, is obtained by moving away the ends of the two portions of spacing edge which are opposite to the pivot axis. As another particular case, the covering member can be pivotally connected to the edge of the first member: in this case the pivot axis will be parallel to them and the passage for the button thread is obtained by removing the edge portion integral with the covering member from the opening formed on the button engaging member. In both cases the operation of mounting the button cover on the button can be performed without stressing the button thread and as a result the button cover is maintained in secure engagement with the button itself.

The invention will now be described in more detail by way of examples with reference to the accompanying drawing in which.

Figure 1:
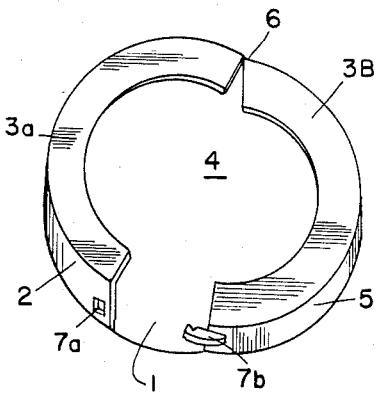
FIG. 1 is a perspective view of one embodiment of a button cover according to the present invention looking from the bottom.
Figure 2:
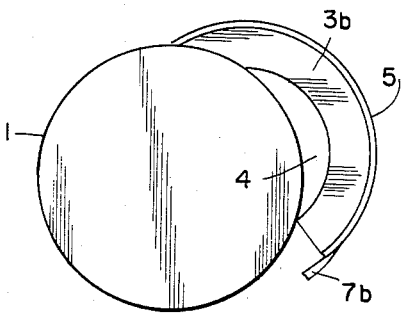
FIG. 2 shows a top view of the button cover of FIG. 1.

Referring now to the drawing and first to FIGS. 1 and 2 thereof, 1 indicates a covering member for the button of substantially flat and circular shape having a perimeter edge 2 extending from one face thereof along a half portion of its contour. 3*a* and 3*b* indicate two parts of a button engaging member of substantially annular shape, thus defining an opening 4. Part 3*a* is integral with covering member 1 and extends inwardly from edge 2. Part 3*b* is provided with an edge 5 equal to edge 2 and is pivotally connected by one end of its edge 5 to a corresponding end 6 of edge 2, so that the pivot axis is perpendicular to covering member 1 and engaging member 3*a, b* lies on a plane parallel to it and in a spaced relationship by virtue of edges 2 and 5. Fastening means 7*a* and 7*b* of any known type are provided at the free ends of edges 2 and 4 for securing the moving part 3*b* of engaging member to the part 3*a* integral with covering member 1. In the present embodiment said fastening means consist of a groove 7*a* formed on edge 2 and a resilient appendix 7*b* tangentially projecting from edge 5 having a tooth-shaped end for engaging with said groove 7*a*. The width of opening 4 on engaging members 3*a*, 3*b* is less than the one on the button to be covered so that, when it is placed under the covering member 1, it abuts on the inner side of engaging members 3*a*, 3*b* and after engaging appendix 7*b* with groove 7*a* the button cannot escape from the button cover.

Figure 3:
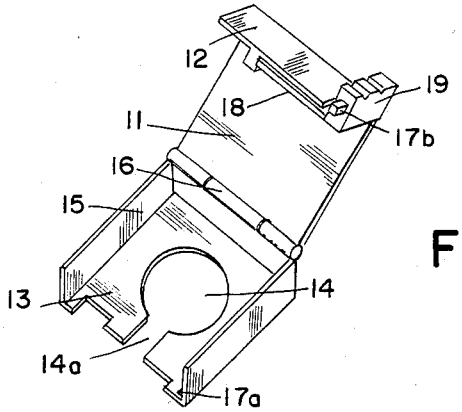
FIG. 3 shows another embodiment of a button cover according to the present invention in a perspective view.

Referring now to FIG. 3, where a second embodiment of the invention is shown, 11 indicates a button covering member of substantially flat, four-sided shape having a projecting edge 12 extending from one of its sides. It has been indicated at 13 a four-sided button engaging member having an opening 14 and a projecting edge 15 formed on the sides corresponding to the non-edged sides of covering member 11. Engaging member 13 is pivotally connected to covering member 11, pivot connection 16 being provided between the side of covering member 11 opposite to edge 12 and a portion of edge 5 opposite to the not-edged side of engaging member 13. The pivot axis 16 is therefore parallel to the plane of engaging member 13 so that when covering member 11 is closed on a button, they are in a spaced apart, parallel relationship.

Fastening means 17*a*, 17*b* are provided on edge 12 and on engaging member 13 for securing the last to the covering member 11 after the button is interposed therebetween, consisting of a groove 17*a* on engaging member 13 and an appendix 17*b*, resiliently connected to edge 12 by means of leaf spring 18, for engaging with said groove 17*a*. To allow the button to be entered into the button cover when edge 12, 15 is discontinued by the cover 11 being raised, a radial cut 14*a* is provided on engaging member 13 extending from its non-edged side to opening 14 for passing the button thread therethrough. The width of opening 14 is less than the diameter of the button to be covered, so that when it is placed in correspondence with said opening 14, it abuts against inner side of engaging member 13. Therefore, after closing covering member 11 on engaging member 13 and connecting fastening means 17*a*, 17*b*, the button cover is firmly secured to the button housed therein. To disengage appendix 17*b* from groove 17*a*, it is sufficient to press a small button 19, from which said appendix projects, connected by means of leaf-spring 18 to edge 12.

In order to give to the button cover according to the invention an aesthetically pleasing appearence, it will be made preferably of precious material and subjected to surface working. In particular the face of covering members 1, 11 of the button covers of FIGS. 1 and 3 respectively, that in use will remain in view, may be used as a support for decorations, drawings, trademarks and so on or for the application of precious stones. It is apparent that the shape of the button cover as previously described and illustrated is not limiting and any other suitable shape thereof has to be considered as being included within the scope of the invention.

While the invention has been described in detail above, it is to be understood that this detailed description is by way of examply only, and the protection granted is to be limited only within the spirit of the invention and the scope of the following claims.

I claim:

1. A button cover comprising a first member having an opening for engaging the button in a substantially coaxial relation, adapted to be interposed between the button and the cuff to which it is sewn, said opening having a smaller diameter than that of the button itself; a second member designed to cover the button and articulated with respect to the first member in order to be placed in a parallel, spaced relationship with respect to the button; a perimeter spacing edge between said first and second members formed by two complementary portions respectively integral with said first and second members; an articulated connection between said first and second members for discontinuing said perimeter spacing edge, thus providing a passage for the button thread when accommodating the button therebetween; means for securing said first and second members in a closed superimposed position, said articulated connection including a hinge axis between said first and second members, and said hinge axis being disposed generally perpendicular to said button.

2. A button cover according to claim 1, wherein said first member is substantially flat and annular in shape and is formed by two separable parts, the first one being integral with said portion of the spacing edge fixed to said second member, the second one extending from the remaining portion of the spacing edge, said hinge axis being located between corresponding ends of said portions of said spacing edge, and said hinge axis being located generally perpendicular to said covering member.

3. A button cover to cause a shirt cuff button to simulate a cufflink, comprising:

first and second cover portions, said first cover portion provided with a substantially flat rectangular shaped button wall wherein at least one side of said button wall includes button receiving means and lock receiving means, and wherein at most three sides of said button wall are provided with perpendicularly adjacent side walls, and said second cover portion includes a substantially flat rectangular shaped top wall provided on at least one side with a perpendicularly disposed, adjacent side wall and lock means to mate with said button wall and said lock receiving means of said first cover portion;

means for hinging said first and second cover portions together about an axis, the hinge axis of said hinging means being disposed generally above and parallel to the plane of said button and said button wall of said first cover portion; and means to hold said button trapped in said first cover portion when said second cover portion is closed over said button and closed on said first cover portion.

4. The combination of claim 3, wherein said means to hold said button trapped in said button wall of said first cover portion comprises an aperture in said button wall of said first cover portion to receive said button, said aperture adapted to rest in the plane above said shirt garment and below the plane of said button.

5. The combination of claim 3, wherein said first and second cover portions comprise means to cause a shirt cuff button to simulate a cufflink.

* * * * *